US011566761B2

(12) United States Patent
Yasukura et al.

(10) Patent No.: US 11,566,761 B2
(45) Date of Patent: Jan. 31, 2023

(54) WALL LAMP

(71) Applicant: KOITO MANUFACTURING CO., LTD., Tokyo (JP)

(72) Inventors: Tadayuki Yasukura, Shizuoka (JP); Tomoyuki Mukai, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/420,437

(22) PCT Filed: Jan. 10, 2020

(86) PCT No.: PCT/JP2020/000702
§ 371 (c)(1),
(2) Date: Jul. 2, 2021

(87) PCT Pub. No.: WO2020/149238
PCT Pub. Date: Jul. 23, 2020

(65) Prior Publication Data

US 2022/0082222 A1 Mar. 17, 2022

(30) Foreign Application Priority Data

Jan. 17, 2019 (JP) ..... JP2019-006431
Jan. 17, 2019 (JP) ..... JP2019-006432

(51) Int. Cl.

| | |
|---|---|
| ***F21S 8/00*** | (2006.01) |
| ***F21V 29/70*** | (2015.01) |
| ***F21V 19/00*** | (2006.01) |
| ***F21V 23/00*** | (2015.01) |

(52) U.S. Cl.
CPC ..... *F21S 8/033* (2013.01); *F21V 19/001* (2013.01); *F21V 23/002* (2013.01); *F21V 29/70* (2015.01)

(58) Field of Classification Search
CPC ..... F21S 8/033; F21V 29/70; F21V 19/001; F21V 23/002
See application file for complete search history.

(56) References Cited

U.S. PATENT DOCUMENTS

| | | | |
|---|---|---|---|
| 2017/0056694 A1 | 3/2017 | Slaton et al. | |
| 2019/0104592 A1 | 4/2019 | Fukushima et al. | |
| 2022/0082222 A1* | 3/2022 | Yasukura | F21V 29/70 |

FOREIGN PATENT DOCUMENTS

| | | |
|---|---|---|
| CA | 2 935 048 A1 | 2/2017 |
| EP | 3 135 472 A1 | 3/2017 |
| EP | 3 434 971 A1 | 1/2019 |
| JP | 2011-003185 A | 1/2011 |

(Continued)

OTHER PUBLICATIONS

International Search Report for PCT/JP2020/000702 dated Mar. 17, 2020 (PCT/ISA/210).

*Primary Examiner* — Anabel Ton
(74) *Attorney, Agent, or Firm* — Sughrue Mion, PLLC

(57) ABSTRACT

A wall lamp (1) is fixed to both an airframe (2) of an aircraft and a wall surface sheet (3) covering the airframe (2). The wall lamp (1) includes a light source (30), a light source holder (50) that is attached to the wall surface sheet (3) and holds the light source (30), and an attachment portion (60) that is attached to the light source holder (50) and the airframe (2). The attachment portion (60) is formed of a material having a melting point lower than that of a material forming the light source holder (50).

17 Claims, 4 Drawing Sheets

(56) References Cited

FOREIGN PATENT DOCUMENTS

| | | | | | |
|---|---|---|---|---|---|
| JP | 2011-216212 | A | | 10/2011 | |
| JP | 2012-069370 | A | | 4/2012 | |
| JP | 2012-099335 | A | | 5/2012 | |
| JP | 2016-046047 | A | | 4/2016 | |
| JP | 2016-180485 | A | | 10/2016 | |
| JP | 2016180485 | A | * | 10/2016 | |
| JP | 2017-016924 | A | | 1/2017 | |
| JP | 2017-104493 | A | | 6/2017 | |
| JP | 2017-139193 | A | | 8/2017 | |
| JP | 2017139193 | A | * | 8/2017 | |
| JP | 2018-014269 | A | | 1/2018 | |
| JP | 2018014269 | A | * | 1/2018 | |
| JP | 2018-045957 | A | | 3/2018 | |
| WO | 2017/187819 | A1 | | 11/2017 | |
| WO | WO-2017187819 | A1 | * | 11/2017 | ..... F21S 8/024 |

* cited by examiner

WALL LAMP

CROSS REFERENCE TO RELATED APPLICATIONS

This application is a National Stage of International Application No. PCT/JP2020/000702 filed Jan. 10, 2020, claiming priority based on Japanese Patent Application No. 2019-006431 filed Jan. 17, 2019, and Japanese Patent Application No. 2019-006432 filed Jan. 17, 2019.

TECHNICAL FIELD

The present invention relates to a wall lamp.

BACKGROUND ART

As a wall lamp, for example, a wall lamp as shown in Patent Literature 1 described below is known. This wall lamp is a wall lamp attached to the wall surface of a cargo compartment of an aircraft, and includes a housing attached to a cargo compartment liner, which is the wall surface of the cargo compartment, and a light source attached to the surface of the housing on a cargo compartment side.

[Patent Literature 1] JP 2011-003185 A

SUMMARY OF INVENTION

A wall lamp according to a first aspect of the present invention is a wall lamp attached to both a structure main body and a wall surface covering the structure main body, the wall lamp including: a light source; a light source holder configured to be attached to the wall surface and hold the light source; and an attachment portion configured to be attached to the light source holder and the structure main body, in which the attachment portion is formed of a material having a melting point lower than a melting point of a material forming the light source holder.

According to this wall lamp, the light source holder attached to the wall surface is formed of a material having a melting point higher than that of the attachment portion. Therefore, even if the wall lamp is exposed to a flame, the light source holder is less likely to be burnt out than the attachment portion. Therefore, as compared with the case where the entire wall lamp is formed of the material forming the attachment portion, the flame is inhibited from spreading to the attachment portion side, and the burning of the attachment portion is suppressed. Further, since the attachment portion of the wall lamp is formed of a material having a melting point lower than that of the light source holder as described above, even if the shape of the attachment portion is complicated, it can be easily molded into a desired shape. Therefore, according to this wall lamp, excellent fire resistance and manufacturability can be realized.

Further, in the wall lamp of the first aspect, it is preferable that the attachment portion includes a wire accommodating portion that accommodates a part of a power supply wire that supplies electric power to the light source.

By providing such wire accommodating portion, the wire can be compactly accommodated and the installation space for the wall lamp can be reduced.

Further, in the wall lamp of the first aspect, when the attachment portion includes the wire accommodating portion, it is preferable to further include: a substrate configured to be fixed to the light source holder and on which the light source is mounted, in which the light source holder is formed with an opening communicating with the wire accommodating portion, and the opening is closed by the substrate on a side opposite to a wire accommodating portion side.

In this case, the light source is attached to the light source holder via the substrate. Further, since the opening is closed by this substrate, it is possible to suppress the flame from entering the attachment portion side through the opening.

When the wall lamp of the first aspect includes the substrate, it is preferable that the substrate includes a metal layer formed separately from a wiring layer, and the metal layer covers at least a part of the opening.

According to such a configuration, even if the resin forming an insulating layer of the substrate is burnt by the flame, the state in which the opening is closed can be maintained by the metal layer. Therefore, it is possible to more effectively suppress the flame from entering the attachment portion side.

Further, when the wall lamp of the first aspect includes the substrate, it is preferable that the power supply wire accommodated in the wire accommodating portion is connected to the substrate through the opening.

In this case, the power supply wire can be connected to the substrate at a short distance, and the length of the power supply wire can be shortened.

Further, when the wall lamp of the first aspect includes the substrate, it may further include a first sheet member having a heat dissipation property configured to be sandwiched and fixed between the substrate and the light source holder.

In this case, the heat of the substrate can be effectively dissipated to the light source holder.

Further, when the wall lamp of the first aspect includes the substrate, it is preferable to further include: a retainer configured to be formed of a material having a melting point higher than a melting point of a material forming the attachment portion, in which the substrate is sandwiched and fixed between the retainer and the light source holder.

By arranging such a retainer, it is possible to suppress the portion where the substrate is attached to the light source holder from being burnt out, and it is possible to suppress the substrate from falling off from the light source holder and exposing the opening. Therefore, it is possible to effectively suppress the flame from entering the attachment portion side through the opening.

Further, when the wall lamp of the first aspect includes the retainer, it may further include: a second sheet member having a heat dissipation property configured to be sandwiched and fixed between the substrate and the retainer.

In this case, the heat of the substrate can be effectively dissipated to the retainer.

Further, the wall lamp of the first aspect may further include a cover member having a light transmitting property that covers the light source.

By providing such a cover member, it is possible to suppress damage to the light source, the wiring layer of the substrate, and the like.

Further, in the wall lamp of the first aspect, it is preferable that the attachment portion includes a flange portion that projects toward an outer periphery of the light source holder and comes into surface contact with the light source holder.

When the flange portion of the attachment portion comes into surface contact with the light source holder in this way, warping of the light source holder when the light source holder is exposed to the flame is suppressed. Therefore, a gap is suppressed from being generated between the light source holder and the attachment portion, and the flame is suppressed from entering the attachment portion side.

In the wall lamp of the first aspect, when the attachment portion includes the flange portion, it is preferable that the attachment portion further includes an extending portion extending from the flange portion toward the outer periphery of the light source holder.

With such an extending portion, it is possible to more effectively suppress the warping of the light source holder.

As described above, according to the wall lamp of the first aspect of the present invention, the wall lamp having excellent fire resistance and manufacturability is provided.

The wall lamp of the second aspect of the present invention is a wall lamp attached to a wall surface, the wall lamp including: a substrate on which a light source is mounted; and a light source holder configured to hold the substrate, in which the light source holder includes: a bottom portion to which the substrate is fixed and that is parallel to the substrate, a sidewall that is erected on an outer edge of the bottom portion and forms a recess portion together with the bottom portion, and a wall surface fixing portion that fixes the light source holder to the wall surface on an opposite side of the bottom portion across the sidewall, and the light source mounted on the substrate is accommodated in the recess portion.

According to this wall lamp, a wall surface fixing portion for fixing the wall lamp to the wall surface is provided on the opposite side of the bottom portion across the sidewall. Therefore, the recess portion formed by the bottom portion and the sidewall can be positioned on the structure main body side with respect to the wall surface and can be directed to face an indoor side. The light source mounted on the substrate is accommodated in such recess portion. Therefore, according to this wall lamp, the light source is suppressed from protruding into an indoor side, and an article or the like is suppressed from hitting the light source and causing damage. Further, as described above, since the light source is suppressed from protruding to the indoor side, it is also excellent in aesthetic appearance.

Further, according to the wall lamp, since the bottom portion of the light source holder is parallel to the substrate, substantially the entire surface of the substrate facing the bottom portion can be fixed to the bottom portion. Therefore, the heat of the light source or the substrate can be effectively dissipated to the light source holder, and an increase in temperature of the light source or the substrate can be effectively suppressed. Note that fixing referred to here includes not only the case where the substrate is directly fixed to the bottom portion but also the case where the substrate is fixed to the bottom portion via another member.

Note that, in the wall lamp of the second aspect, it is preferable that the light source holder further includes a flange portion that projects radially outward from an end portion of the sidewall opposite to a bottom portion side, and the flange portion comes into surface contact with the wall surface.

In this case, since the flange portion comes into surface contact with the wall surface, the heat dissipated to the light source holder can be effectively dissipated to the wall surface.

Further, in the wall lamp of the second aspect, when the light source holder includes the flange portion, it is preferable that the wall surface fixing portion is provided in the flange portion.

By providing the wall surface fixing portion in the flange portion, the flange portion and the wall surface can be firmly fixed by surface contact as compared with the case where the wall surface fixing portion is provided in a portion other than the flange portion.

Further, the wall lamp of the second aspect, it is preferable to further include: a power supply wire configured to be connected to the substrate and supply electric power to the light source, in which an opening for inserting the power supply wire toward the substrate is formed in the bottom portion.

In this case, since the power supply wire can be connected to the substrate from the back side of the substrate, the exposure of the power supply wire is suppressed. Therefore, it is possible to further improve the aesthetic appearance when the wall lamp is attached to the wall surface. Further, the power supply wire can be connected to the substrate at a short distance, and the length of the power supply wire can be shortened.

When the wall lamp of the second aspect includes the power supply wire, it is preferable that the opening is closed by the substrate.

In this case, the opening can be made invisible from the indoor side, and the aesthetic appearance when the wall lamp is attached to the wall surface can be further improved. Further, dust and the like are suppressed from entering an airframe main body side through the opening.

Further, it is preferable that the wall lamp of the second aspect further includes: a cover member having a light transmitting property configured to cover the light source, in which a light source facing portion of the cover member facing the light source is formed parallel to the bottom portion.

In this case, the cover member can be formed flat, and the cover member does not easily protrude from the recess portion even when the recess portion is thinned. Therefore, even when the recess portion is thinned, it is possible to effectively suppress an article or the like from hitting the cover member.

When the wall lamp of the second aspect includes the cover member, it is preferable that the light source facing portion is accommodated in the recess portion.

In this case, the recess portion can be thinned, and it is possible to more effectively suppress an article from hitting the cover member.

Further, in the wall lamp of the second aspect, a sheet member having a heat dissipation property may be arranged between the bottom portion and the substrate.

In this case, the substrate is fixed to the bottom portion of the light source holder via the sheet member. By fixing the substrate to the bottom portion via the sheet member having a heat dissipation property, it is possible to more effectively suppress an increase in temperature of the substrate or the light source.

As described above, according to the wall lamp of the second aspect of the present invention, the wall lamp that is hardly damaged and has excellent aesthetic appearance is provided.

DESCRIPTION OF EMBODIMENTS

Figure 1:
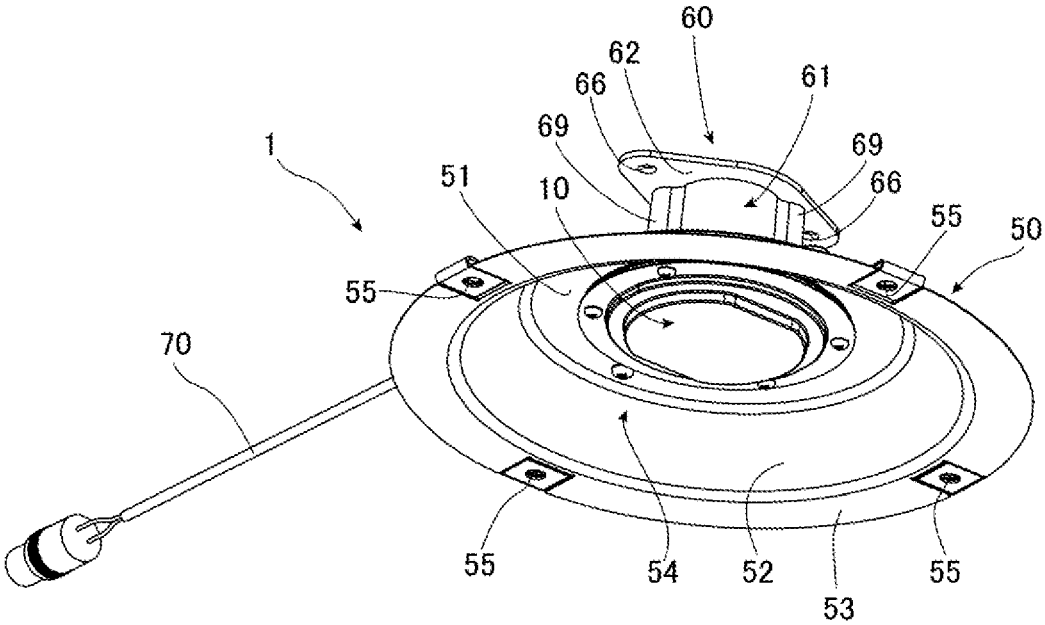
FIG. 1 is a front perspective view of a wall lamp according to a first embodiment of the present invention.

Aspects for carrying out the wall lamp according to the present invention will be illustrated below together with the accompanying drawings. The embodiments illustrated below are for facilitating the understanding of the present invention, and are not for limiting the interpretation of the present invention. The present invention can be changed or modified from the embodiments below without departing from the spirit. Note that, in the drawings referred to below, the dimensions of each member may be changed for ease of understanding.

First Embodiment

First, the first aspect of the present invention will be described by taking the wall lamp according to the first embodiment as an example. FIG. 1 is a front perspective view of a wall lamp 1 according to the first embodiment. In the present embodiment, the wall lamp 1 is a lamp for the cargo compartment of an aircraft. As shown in FIG. 1, the wall lamp 1 includes, as main configurations, a light unit 10, a light source holder 50 that holds the light unit 10, an attachment portion 60 attached to the surface of the light source holder 50 opposite to the surface that holds the light unit 10, and a power supply wire 70 for supplying electric power to the light unit 10. As will be described later, the light unit 10 includes a light source made of an LED and a cover member that covers the light source. Electric power is supplied to the light source via the power supply wire 70.

The light source holder 50 is formed of stainless steel and has a substantially disk-shaped outer shape with a recessed central portion. Specifically, the light source holder 50 includes a bottom portion 51 to which the light unit 10 is fixed, and a sidewall 52 erected on the outer edge of the bottom portion 51. The sidewall 52 extends from the outer edge of the bottom portion 51 to the side opposite to the attachment portion 60 side while gradually increasing in diameter. The sidewall 52 and the bottom portion 51 form a recess portion 54 in the center of the light source holder 50. From the end portion of the sidewall 52 where the diameter is the largest, a flange portion 53 formed substantially parallel to the bottom portion 51 projects radially outward. Fastener holes 55 for inserting fasteners are formed at four positions of the flange portion 53.

The attachment portion 60 is formed of a material having a melting point lower than that of the light source holder 50, and, in the present embodiment, is formed of aluminum. The attachment portion 60 includes a main body portion 61 attached to the bottom portion 51 of the light source holder 50, and a structure fixing portion 62 attached to the side of the main body portion 61 opposite to the light source holder 50 side. The main body portion 61 is formed in a cylindrical shape, and a part of the power supply wire 70 is accommodated in the internal space of the main body portion 61. Further, as shown in FIG. 1, fastener holes 66 for inserting fasteners are formed in both side portions of the structure fixing portion 62 across the main body portion 61. Note that the main body portion 61 is formed with a pair of protruding portions 69 protruding in opposite directions.

Figure 2:
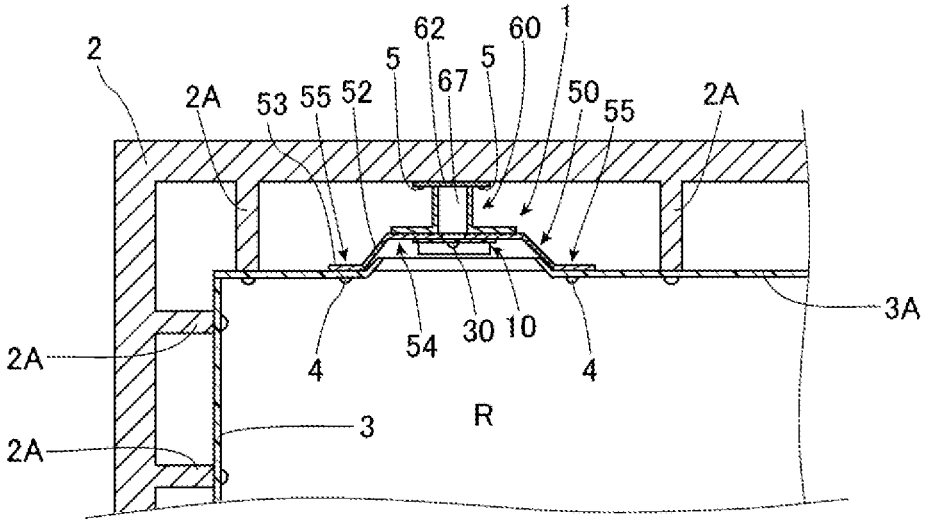
FIG. 2 is a cross-sectional view schematically showing a state in which the wall lamp shown in FIG. 1 is attached to a cargo compartment of an aircraft.

FIG. 2 is a cross-sectional view schematically showing a state in which the wall lamp 1 is attached to the cargo compartment of an aircraft. Note that, in FIG. 2, the illustration of the power supply wire 70 is omitted.

As shown in FIG. 2, the aircraft to which the wall lamp 1 is attached has an airframe 2, which is the structure main body. The airframe 2 separates the inner space of the aircraft from the external space. The airframe 2 has a plurality of beam portions 2A protruding toward the inner space. A plurality of wall surface sheets 3 is fixed to the beam portions 2A, and the airframe 2 is covered by these wall surface sheets 3. In this way, the wall surface sheets form the wall surface of a cargo compartment R of the aircraft. That is, the airframe 2, which is the structure main body, is positioned on the outside of the wall surface sheets 3, and the cargo compartment R of the aircraft is positioned on the inside of the wall surface sheets 3. Note that the member forming the wall surface may be a panel-shaped member.

In the present embodiment, the wall lamp 1 is attached to both a ceiling sheet 3A of the plurality of wall surface sheets 3, and the airframe 2. Note that the wall lamp 1 may be attached to the wall surface sheet 3 other than the ceiling sheet 3A. The ceiling sheet 3A is formed with an opening having a diameter slightly smaller than the maximum diameter of the sidewall 52 of the light source holder 50. Further, in the ceiling sheet 3A, fastener holes, which are not shown, for inserting fasteners are formed in four positions around the opening. In the present embodiment, the opening of the ceiling sheet 3A is positioned in the recess portion 54 of the light source holder 50, the fastener holes of the ceiling sheet 3A and the fastener holes 55 of the light source holder 50 are communicated with each other, and fasteners such as screws 4 are inserted and fastened into the fastener holes of the ceiling sheet 3A and the fastener holes 55 of the light source holder 50, which are communicated with each other. In this way, the light source holder 50 is attached to the ceiling sheet 3A. Specifically, the flange portion 53 of the light source holder 50 and the substantially lower half of the sidewall 52 are substantially in close contact with the ceiling sheet 3A, and the light source holder 50 is fixed to the ceiling sheet 3A. On the other hand, the attachment portion 60 is fixed to the airframe 2 by inserting and fastening fasteners such as screws 5 into the fastener holes 66 of the structure fixing portion 62 of the attachment portion 60. In this way, the wall lamp 1 is attached to the ceiling sheet 3A, which is the wall surface, and the airframe 2, which is the structure main body.

Note that, in the example of FIG. 2, the wall lamp 1 is attached to the ceiling sheet 3A so that the ceiling sheet 3A is positioned on the cargo compartment R side with respect to the flange portion 53, but the wall lamp 1 may be attached to the ceiling sheet 3A so that the ceiling sheet 3A is positioned on the airframe 2 side with respect to the flange portion 53.

Figure 3:
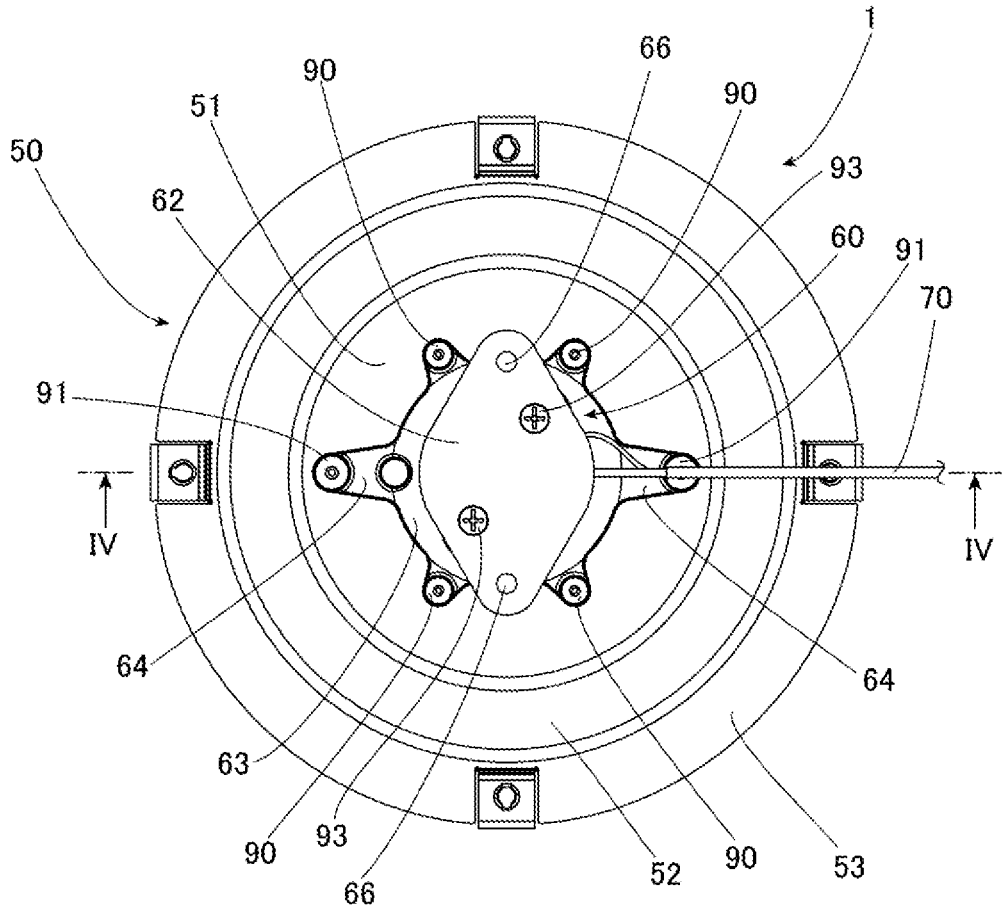
FIG. 3 is a rear view of the wall lamp shown in FIG. 1.

Next, the light source holder 50 and the attachment portion 60 will be described in more detail. FIG. 3 is a rear view of the wall lamp 1, and FIG. 4 is a cross-sectional view taken along the line IV-IV shown in FIG. 3.

Figure 4:
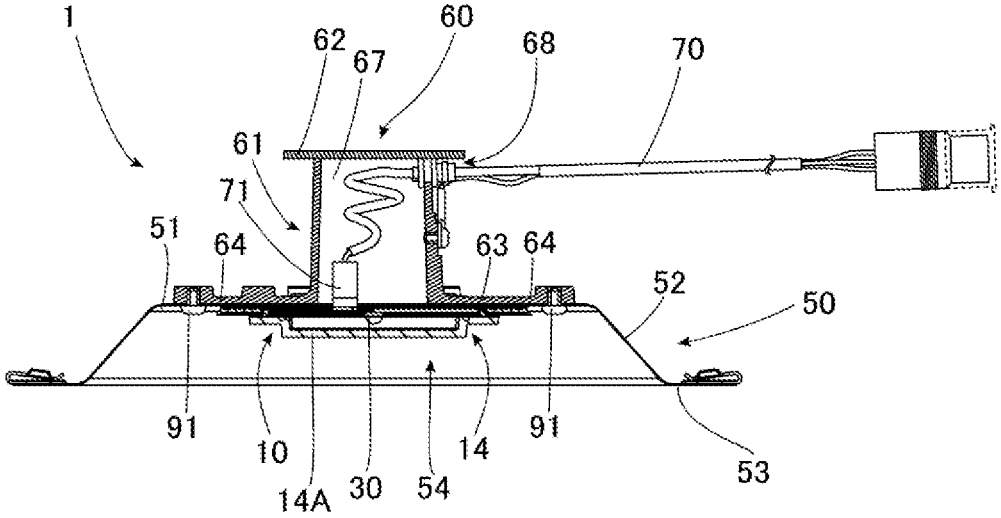
FIG. 4 is a cross-sectional view taken along the line IV-IV shown in FIG. 3.

As shown in FIGS. 3 and 4, a flange portion 63 that projects toward the outer periphery of the light source holder 50 is formed at the end portion of the main body portion 61 of the attachment portion 60 on the light source holder 50 side. Fastener holes through which fasteners can be inserted are formed in four positions of the flange portion 63. Further, fastener holes are also formed in portions of the bottom portion 51 of the light source holder 50 that overlap with the fastener holes of the flange portion 63. Screws 90, which are fasteners, are inserted and fastened into the fastener holes of the flange portion 63 and the fastener holes of the bottom portion 51, which are communicated with each other in this way. In this way, the flange portion 63 is fixed to the light source holder 50 in a state of being in surface contact with the surface of the bottom portion 51 of the light source holder 50 opposite to the side to which the light unit 10 is attached.

Further, the main body portion 61 includes a pair of extending portions 64 extending in opposite directions from the flange portion 63 toward the outer periphery of the light source holder 50. At each of the end portions of the extending portions 64, a fastener hole into which a fastener can be inserted is formed. Further, fastener holes are also formed in portions of the bottom portion 51 of the light source holder 50 that overlap with the fastener holes of the extending portions 64. Screws 91, which are fasteners, are inserted and fastened into the fastener holes of the extending portions 64 and the fastener holes of the bottom portion 51, which are communicated with each other in this way. In this way, the extending portions 64 are fixed to the light source holder 50 in a state of being in surface contact with the surface of the bottom portion 51 of the light source holder 50 opposite to the side to which the light unit 10 is attached.

In the present embodiment, such main body portion 61 is molded, for example, by die casting.

As shown in FIG. 3, fastener holes for fastening screws 93 are formed in the structure fixing portion 62 of the attachment portion 60. These fastener holes are formed in positions overlapping with the protruding portions 69 of the main body portion 61, and fastener holes are also formed in the protruding portions 69. Therefore, the main body portion 61 and the structure fixing portion 62 are fixed by inserting and fastening the screws 93 into the fastener holes of the structure fixing portion 62 and the fastener holes of the protruding portions 69, which are communicated with each other.

Note that, in the present embodiment, the main body portion 61 and the structure fixing portion 62 of the attachment portion 60 are formed as separate bodies, but the main body portion 61 and the structure fixing portion 62 may be molded integrally.

As described above, the main body portion 61 of the attachment portion 60 is formed in a cylindrical shape, and as shown in FIG. 4, a wire accommodating portion 67, which is the internal space, is formed inside the main body portion 61. A part of the power supply wire 70 described above is accommodated in the wire accommodating portion 67. A cutout 68 is formed in a boundary portion of the main body portion 61 with the structure fixing portion 62, and the power supply wire 70 is led out to the outside of the wire accommodating portion 67 through the cutout 68. On the other hand, a connector 71 is attached to the end portion of the power supply wire 70 on the side that is not led out to the outside.

Figure 5:
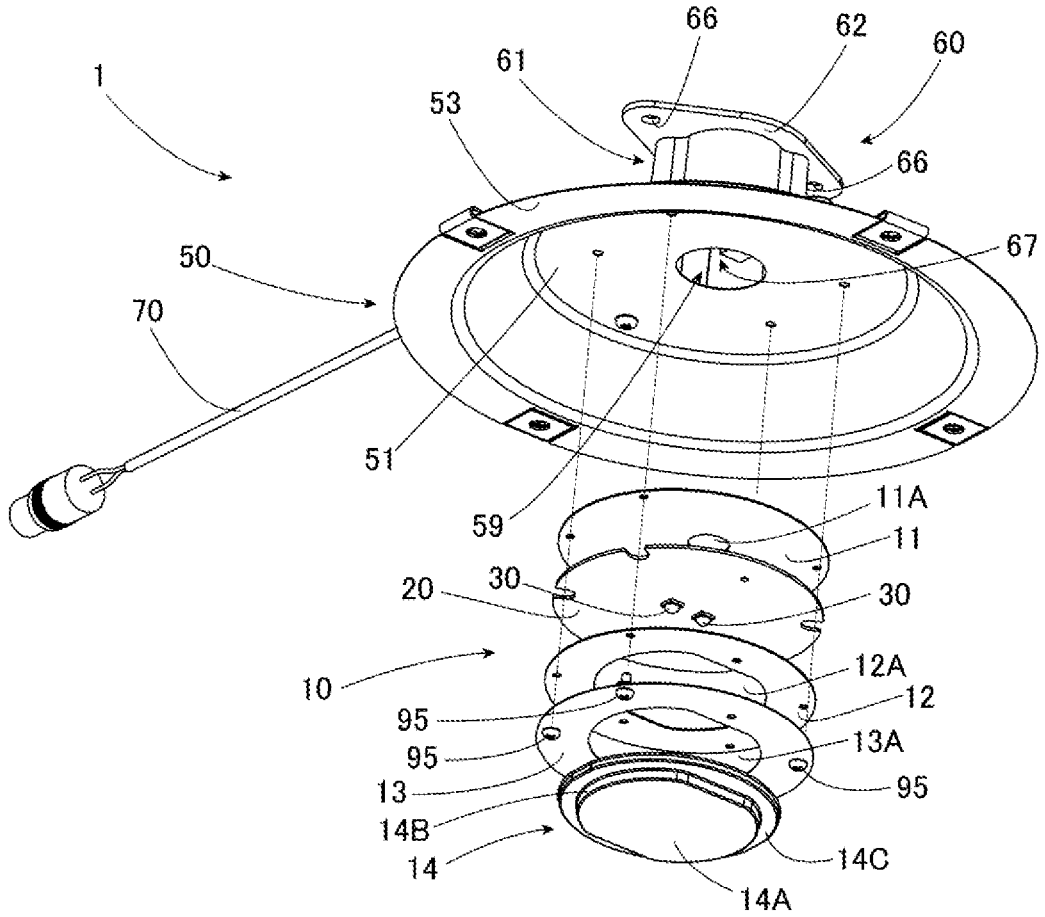
FIG. 5 is a perspective view showing a light unit of the wall lamp shown in FIG. 1 in an exploded manner.

FIG. 5 is a view showing the wall lamp 1 with the light unit 10 in an exploded state from the same viewpoint as in FIG. 1. As shown in FIG. 5, an opening 59 is formed in the substantially central portion of the bottom portion 51 of the light source holder 50. This opening 59 communicates with the wire accommodating portion 67 of the attachment portion 60 on the airframe 2 side, and is closed by the light unit 10 on the cargo compartment R side opposite to the wire accommodating portion 67 side.

The light unit 10 will be described in detail below.

As shown in FIG. 5, the light unit 10 includes, as main configurations, a substrate 20 on which two light sources 30 are mounted, a first sheet member 11 arranged between the substrate 20 and the light source holder 50, a second sheet member 12 arranged on the surface of the substrate 20 on which the light sources 30 are mounted, a retainer 13 arranged on the side of the second sheet member 12 opposite to the substrate 20 side, and a cover member 14 having a light transmitting property arranged on the side of the retainer 13 opposite to the second sheet member 12 side. In this way, the light unit 10 is configured such that the first sheet member 11, the substrate 20, the second sheet member 12, the retainer 13, and the cover member 14 overlap from the light source holder 50 side toward the cargo compartment R side. Note that the number of light sources 30 mounted on the substrate 20 may be one or three or more.

The first sheet member 11, the substrate 20, the second sheet member 12, and the retainer 13 are each formed to have substantially the same outside diameter, and the cover member 14 is formed to have an outside diameter smaller than that of the first sheet member 11, the substrate 20, the second sheet member 12, and the retainer 13.

In the present embodiment, the bottom portion 51 of the light source holder 50, the first sheet member 11, the substrate 20, the second sheet member 12, and the retainer 13 are each formed with four fastener holes communicating with each other. By inserting and fastening screws 95, which are fasteners, into these fastener holes, the first sheet member 11, the substrate 20, the second sheet member 12, and the retainer 13 are overlapped as described above and fixed to the light source holder 50. On the other hand, the cover member 14 is fixed to the retainer 13 via the resin.

Next, the first sheet member 11, the second sheet member 12, the retainer 13, and the cover member 14 will be described in detail.

The first sheet member is a member having a heat dissipation property, and is formed of silicon in the present embodiment. As described above, the first sheet member 11 is arranged between the substrate 20 and the light source holder 50, and is sandwiched and fixed between the substrate 20 and the light source holder 50. An opening 11A is formed in the first sheet member 11, and the opening 11A communicates with the opening 59 of the light source holder 50 and the wire accommodating portion 67 of the attachment portion 60. The power supply wire 70 is led out to the substrate 20 side through the communication openings 59 and 11A.

The second sheet member 12 is a member having a heat dissipation property, and is formed of silicon in the present embodiment. As described above, the second sheet member 12 is arranged between the substrate 20 and the retainer 13, and is sandwiched and fixed between the substrate 20 and the retainer 13. The second sheet member 12 has a substantially ring-shaped outer shape with an opening 12A formed in the central portion, and is arranged on an outer peripheral edge of the substrate 20 so that the light sources 30 mounted on the substrate 20 are positioned within the opening 12A.

The retainer 13 is formed of a material having a melting point higher than that of the material forming the attachment portion 60, and, in the present embodiment, is formed of stainless steel. The retainer 13 has a substantially ring-shaped outer shape with an opening 13A formed in the central portion. The opening 13A of the retainer 13 is formed to have substantially the same outer shape and dimensions as the opening 12A of the second sheet member 12. Therefore, when the retainer 13 is arranged on the second sheet member 12, substantially the entirety of the retainer 13 overlaps with substantially the entirety of the second sheet member 12, and substantially the entirety of the opening 13A of the retainer 13 communicates with substantially the entirety of the opening 12A of the second sheet member 12. In this way, the retainer 13 is fixed to the outer peripheral edge of the substrate 20 via the second sheet member 12, and as a result, the substrate 20 is sandwiched and fixed between the retainer 13 and the light source holder 50.

The cover member 14 is formed of a light-transmitting resin, and, in the present embodiment, is formed of polycarbonate. The cover member 14 includes a light source facing portion 14A extending substantially parallel to the bottom portion 51 of the light source holder 50 and facing the light sources 30, a sidewall 14B erected along the outer periphery of the light source facing portion 14A, and a flange portion 14C that projects radially outward from an end portion of the sidewall 14B on the side opposite to the light source facing portion 14A side. In the present embodiment, the flange portion 14C and the retainer 13 are fixed using resin. In this way, the light sources 30 are covered by the cover member 14. Note that the light source facing portion 14A is textured.

Next, the substrate 20 will be described in detail.

Figure 6:
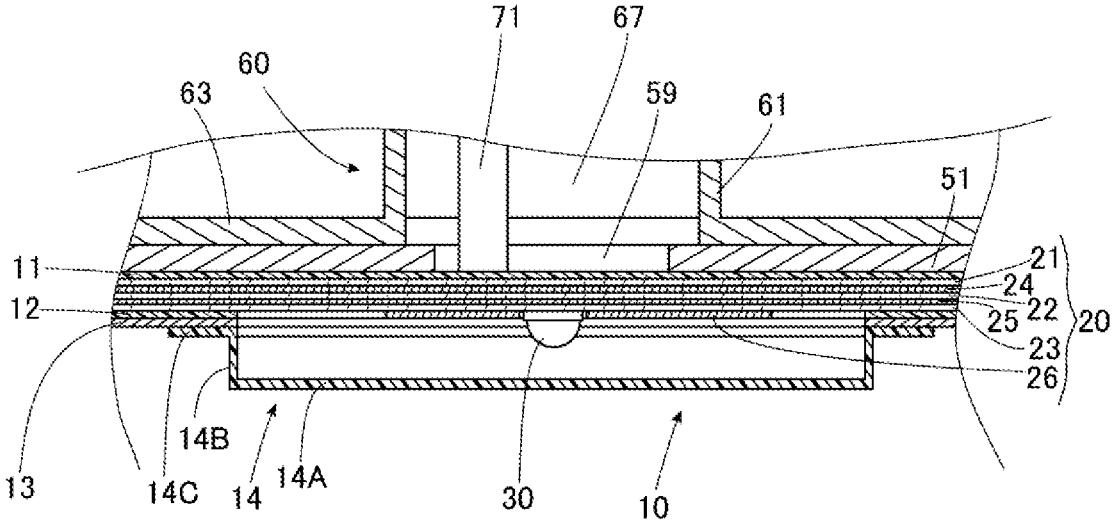
FIG. 6 is a cross-sectional view for explaining the structure of the substrate shown in FIG. 5.

FIG. 6 is a cross-sectional view for explaining the structure of the substrate 20. Note that, in FIG. 6, the thickness of each member is shown exaggerated. As shown in FIG. 6, the substrate 20 is a multilayer substrate, and includes insulating layers 21, 22, 23, metal layers 24, 25, and a wiring layer 26. That is, the substrate 20 includes the metal layers 24, 25 formed separately from the wiring layer 26.

In the present embodiment, the insulating layers 21, 22, 23 are all formed of glass epoxy. The insulating layer 21 is formed on the most wire accommodating portion 67 side among the insulating layers 21, 22, 23, and is in close contact with the first sheet member 11. The insulating layer 22 is formed on the cargo compartment R side with respect to the insulating layer 21, and the insulating layer 23 is formed on the cargo compartment R side with respect to the insulating layer 22.

The metal layer 24 is formed between the insulating layer 21 and the insulating layer 22, and the metal layer 25 is formed between the insulating layer 22 and the insulating layer 23. The metal layers 24, 25 are formed of a metal having a melting point higher than that of epoxy resin, which is the resin forming the insulating layers 21, 22, 23. Each of the metal layers 24, 25 covers at least a part of the opening 59 of the light source holder 50. The thickness of these metal layers 24, 25 is, for example, 70 μm.

The metal layers 24, 25 may be formed of the same metal as the wiring layer 26 or may be formed of a metal having a melting point higher than that of the wiring layer 26. For example, when the wiring layer 26 is formed of copper, the metal layers 24, 25 may be formed of copper or may be formed of, for example, nickel having a melting point higher than that of copper.

The wiring layer 26 is formed on the surface of the insulating layer 23 opposite to the metal layer 25 side. The two light sources 30 are mounted on the wiring layer 26.

The insulating layers 21, 22, 23, the metal layers 24, 25, and the wiring layer 26 constituting the substrate 20 are formed with openings, which are not shown, that communicate with each other. These openings of the substrate 20 communicate with the opening 11A of the first sheet member 11, the opening 59 of the light source holder 50, and the wire accommodating portion 67 of the attachment portion 60. From the wiring layer 26, an electrode, which is not shown, penetrates the openings of the substrate 20 and extends toward the wire accommodating portion 67 side. Electric power is supplied to the light sources 30 when the electrode is connected to the connector 71 of the power supply wire 70. Note that, in the present embodiment, the electrode extending from the wiring layer 26 is not electrically connected to the metal layers 24, 25.

The wall lamp 1 having the above configuration operates as described below.

When a current flows through the power supply wire 70, the current is applied to the wiring layer 26 via the electrode connected to the connector 71, and as a result, electric power is supplied to the light sources 30 mounted on the wiring layer 26. Thus, light is generated in the light sources 30, and the light is emitted from the light sources 30. As described above, the light sources 30 are arranged within the opening 12A of the second sheet member 12 and the opening 13A of the retainer 13. Therefore, it is suppressed that the light emitted from the light sources 30 is blocked by the second sheet member 12 and the retainer 13. Thus, the light emitted from the light sources 30 propagates toward the cargo compartment R side and is incident on the light source facing portion 14A of the cover member 14. As described above, since the light source facing portion 14A is textured, the light incident on the light source facing portion 14A is scattered by the light source facing portion 14A, and the scattered light is emitted to the cargo compartment R from the light source facing portion 14A. When the scattered light is emitted to the cargo compartment R in this way, a wide area of the cargo compartment R is brightly illuminated.

By the way, the wall lamp as described in Patent Literature 1 attached to the cargo compartment of an aircraft or the like needs to have excellent fire resistance from the viewpoint of fire-proof property and the like. Therefore, it is preferable that the housing is formed of a material having a high melting point. However, the housing may be provided with the wire accommodating portion for accommodating the wire for the light source, and the shape of the housing tends to be complicated. In general, a material having a high melting point tends to be difficult to process, and therefore it is difficult to manufacture the housing having a complicated shape by using such material having a high melting point.

Note that the above problem can occur not only in wall lamps attached to the wall surface of the cargo compartment of an aircraft, but also in other wall lamps such as wall lamps attached to the wall surface of a theater.

In this regard, according to the wall lamp 1 of the present embodiment, the effects described below can be obtained.

As described above, according to the wall lamp 1, the light source holder 50 is formed of stainless steel having a melting point higher than that of aluminum forming the attachment portion 60. Therefore, even if the wall lamp 1 is exposed to the flame, the light source holder 50 is less likely to be burnt out than the attachment portion 60. Therefore, as compared with the case where the entire wall lamp 1 is formed of the material forming the attachment portion 60, the flame is inhibited from spreading to the attachment portion 60 side, and the burning of the attachment portion 60 is suppressed. On the other hand, as described above, the attachment portion 60 includes the flange portion 63, the extending portions 64, the pair of protruding portions 69, or the like, and has a complicated outer shape as compared with the light source holder 50. However, as described above, since the attachment portion 60 is formed of aluminum having a melting point lower than that of the stainless steel forming the light source holder 50, the attachment portion 60 can be easily molded as compared with the light source holder 50. For example, it can be easily molded into a desired shape by using die casting. Therefore, according to the wall lamp 1, excellent fire resistance and manufacturability can be realized.

Further, as described above, according to the wall lamp 1, since the attachment portion 60 is formed of aluminum having a specific gravity lower than that of the stainless steel forming the light source holder 50, the wall lamp 1 can be reduced in weight as compared with the case where the entire wall lamp 1 is formed of stainless steel.

Further, as described above, according to the wall lamp 1, the attachment portion 60 includes the wire accommodating portion 67 for accommodating the power supply wire 70 for supplying electric power to the light sources 30. Therefore, the power supply wire 70 can be accommodated compactly, and the installation space for the wall lamp can be reduced.

Further, as described above, the wall lamp 1 includes the substrate 20 that is fixed to the light source holder 50 and on which the light sources 30 are mounted, and the substrate 20 closes the opening 59 formed in the light source holder 50. Therefore, it is possible to more effectively suppress the flame from entering the attachment portion 60 side through the opening 59.

Further, as described above, according to the wall lamp 1, the substrate 20 includes the metal layers 24, 25 formed separately from the wiring layer 26. Further, these metal layers 24, 25 are formed of a metal having a melting point higher than that of the epoxy resin forming the insulating layers 21, 22, 23, and cover at least a part of the opening 59 of the light source holder 50. Therefore, even when the wall lamp 1 is exposed to the flame and the epoxy resin of the substrate 20 is burnt out, the metal layers 24, 25 can maintain the state in which the opening 59 is closed. Therefore, it is possible to suppress the exposure of the opening 59 and more effectively suppress the flame from entering the attachment portion 60 side through the opening 59. Note that, as described above, the metal layers 24, 25 may be formed of a metal having a melting point higher than that of the metal forming the wiring layer 26. In this case, even when the wiring layer 26 is burnt out, the metal layers 24, 25 can maintain the state in which the opening 59 is closed. Therefore, it is possible to further suppress the exposure of the opening 59 and further effectively suppress the flame from entering the attachment portion 60 side through the opening 59.

Further, as described above, according to the wall lamp 1, the power supply wire 70 accommodated in the wire accommodating portion 67 is connected to the substrate 20 through the opening 59 of the light source holder 50 communicating with the wire accommodating portion 67. Therefore, the power supply wire 70 can be connected to the substrate 20 at a shorter distance as compared with the case where the power supply wire 70 is led out through a portion other than the opening 59 to the outside of the wire accommodating portion 67 and connected to the substrate 20. Therefore, the length of the power supply wire 70 can be shortened.

Further, as described above, the wall lamp 1 includes the first sheet member 11 having a heat dissipation property, which is sandwiched and fixed between the substrate 20 and the light source holder 50. Therefore, the heat of the substrate 20 can be effectively dissipated to the light source holder 50. Further, since the first sheet member 11 is formed of silicon as described above, the insulating property between the substrate 20 and the light source holder 50 can be increased.

Further, as described above, the wall lamp 1 includes the retainer 13 formed of stainless steel having a melting point higher than that of aluminum forming the attachment portion 60, and the substrate 20 is sandwiched and fixed between the retainer 13 and the light source holder 50. Therefore, even when the wall lamp 1 is exposed to the flame, the portion of the substrate 20 fixed to the light source holder 50 is protected from the flame by the retainer 13, and the burning of the portion is suppressed. As a result, the substrate 20 is suppressed from falling off from the light source holder 50, and the exposure of the opening 59 is suppressed. Therefore, it is possible to more effectively suppress the flame from entering the attachment portion 60 side through the opening 59.

Further, as described above, the wall lamp 1 includes the second sheet member 12 having a heat dissipation property, which is sandwiched and fixed between the substrate 20 and the retainer 13. Therefore, the heat of the substrate 20 can be effectively dissipated to the retainer 13. Further, since the second sheet member 12 is formed of silicon as described above, the insulating property between the substrate 20 and the retainer 13 can be increased.

Further, as described above, the wall lamp 1 further includes the cover member 14 having a light transmitting property that covers the light sources 30. Therefore, it is possible to suppress damage to the light sources 30, the wiring layer 26 of the substrate 20, and the like.

Further, as described above, according to the wall lamp 1, the attachment portion 60 includes the flange portion 63 that projects toward the outer periphery of the light source holder 50 and comes into surface contact with the light source holder 50. When the flange portion 63 of the attachment portion 60 comes into surface contact with the light source holder 50 in this way, it is possible to suppress the light source holder 50 from warping when the light source holder 50 is exposed to the flame. As a result, a gap is suppressed from being generated between the light source holder 50 and the attachment portion 60, and the flame is effectively suppressed from entering the attachment portion 60 side.

Further, as described above, according to the wall lamp 1, the attachment portion 60 includes the extending portions 64 that extend from the flange portion 63 toward the outer periphery of the light source holder 50. With such extending portions 64, it is possible to more effectively suppress the warping of the light source holder 50.

Although the first aspect of the present invention has been described above by taking the first embodiment as an example, the first aspect is not limited to the present embodiment.

For example, it is not essential to provide the first sheet member 11 or the second sheet member. That is, only the first sheet member 11 may be provided, only the second sheet member 12 may be provided, or both the first sheet member 11 and the second sheet member 12 may not be provided.

Further, in the first embodiment, the example in which the number of extending portions 64 is two has been described, but the number of extending portions 64 may be three or more. For example, when the number of extending portions 64 is three, the extending portions 64 may be arranged at intervals of 120° along the circumferential direction of the flange portion 63. By providing the extending portions 64 at equal intervals along the circumferential direction of the flange portion 63 in this way, it is possible to effectively suppress the light source holder 50 from warping.

Further, it is not essential to provide the attachment portion 60 with the flange portion 63 or the extending portions 64. That is, only the flange portion 63 may be provided, only the extending portions 64 may be provided, or both the flange portion 63 and the extending portions 64 may not be provided.

Further, in the first embodiment, the example in which the two metal layers 24, 25 are provided on the substrate 20 has been described, but the number of metal layers is not limited to this. For example, the number of metal layers may be one or three or more. Alternatively, the metal layers may not be provided. However, as described above, it is preferable to provide at least one metal layer from the viewpoint of suppressing the flame from entering the attachment portion 60 side through the opening 59 of the light source holder 50.

Further, it is not essential to provide the retainer 13. However, as described above, it is preferable to provide the retainer from the viewpoint of suppressing the flame from entering the attachment portion 60 side through the opening 59 of the light source holder 50.

Further, it is not essential to provide the cover member 14. However, as described above, it is preferable to provide the cover member 14 from the viewpoint of protecting the light sources 30, scattering the light, and the like.

Further, in the first embodiment, the example in which the light source holder 50 is formed of stainless steel and the attachment portion 60 is formed of aluminum has been described, but when the attachment portion 60 is formed of a material having a melting point lower than that of the material forming the light source holder 50, the light source holder 50 and the attachment portion 60 may be made of different materials.

Further, in the first embodiment, the example in which the light sources 30 are an LED has been described, but the light sources 30 may be, for example, an incandescent light bulb. In this case, it is not necessary to provide the substrate 20 on the wall lamp.

Further, in the first embodiment, the example in which the wall lamp 1 is applied to the cargo compartment of an aircraft has been described, but it is not limited to the first embodiment in the case of a structure in which the structure main body is covered by the wall surface. For example, it can be applied to the cabin of an aircraft, or it can be applied to the wall surface of a theater.

According to the wall lamp of the first aspect of the present invention, the wall lamp having excellent fire resistance and manufacturability is provided, and it can be used, for example, in the field of aircrafts.

Second Embodiment

Next, the second aspect of the present invention will be described by taking the wall lamp according to the second embodiment as an example. Note that the same or equivalent components as those of the first embodiment are designated by the same reference numerals and duplicated description will be omitted unless otherwise specified.

The wall lamp 1 according to the present embodiment has substantially the same configuration as the wall lamp 1 of the first embodiment. Therefore, the front perspective view of the wall lamp 1 of the present embodiment is shown in the same manner as in FIG. 1, the rear view of the wall lamp 1 of the present embodiment is shown in the same manner as in FIG. 3, the cross-sectional view of the present embodiment corresponding to the cross-sectional view taken along the line IV-IV of the first embodiment is shown in the same manner as in FIG. 4, the perspective view showing the light unit 10 of the present embodiment in an exploded manner is shown in the same manner as in FIG. 5, and the cross-sectional view of the substrate of the present embodiment is shown in the same manner as in FIG. 6.

Figure 7:
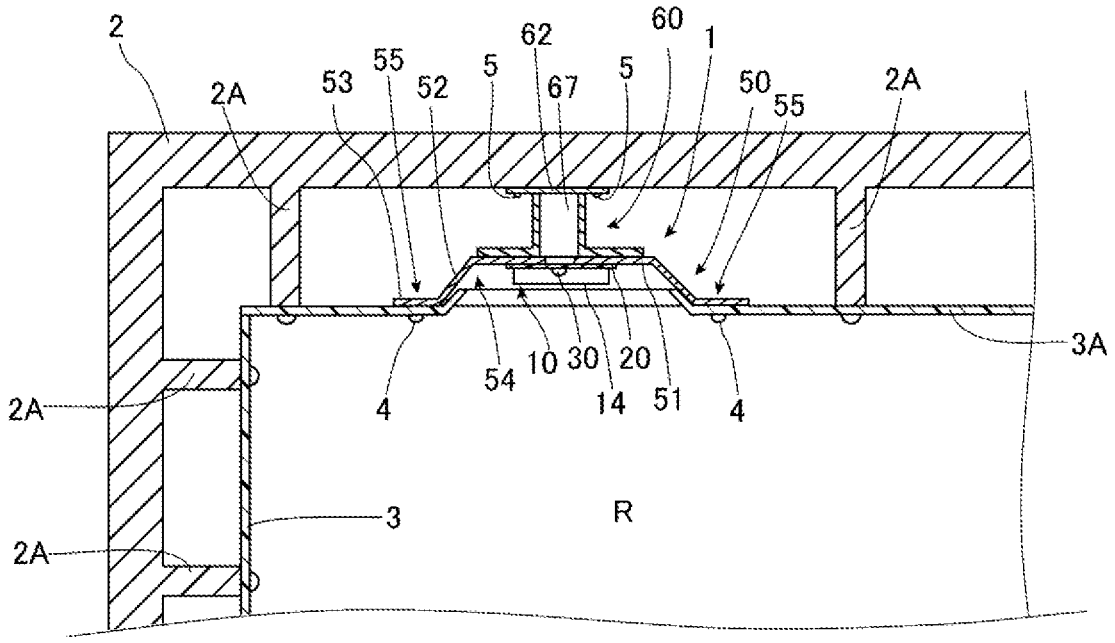
FIG. 7 is a cross-sectional view showing a state in which a wall lamp according to a second embodiment of the present invention is attached to a cargo compartment of an aircraft from the same viewpoint as in FIG. 2.

FIG. 7 is a cross-sectional view showing a state in which the wall lamp 1 according to the present embodiment is attached to the cargo compartment R of an aircraft from the same viewpoint as in FIG. 2. Note that, in FIG. 7, the illustration of the power supply wire 70 is omitted. As shown in FIG. 7, the light unit 10 includes the two light sources 30 including an LED, the substrate 20 on which the light sources 30 are mounted, and the cover member 14 having a light transmitting property that covers the light sources 30. The two light sources 30 are arranged side by side from the front side to the back side of the paper in FIG. 7. Electric power is supplied to the light sources 30 via the power supply wire 70. The cover member 14 has a generally flat outer shape.

The bottom portion 51 of the light source holder 50 of the present embodiment is formed parallel to the substrate 20 of the light unit 10. The sidewall 52 of the light source holder 50 of the present embodiment forms the recess portion 54 in the center of the light source holder 50 together with the bottom portion 51. The recess portion 54 faces the cargo compartment R side, and the light unit 10 is accommodated in the recess portion 54. From the end portion of the sidewall 52 opposite to the bottom portion 51 side, the flange portion 53 formed substantially parallel to the bottom portion 51 projects radially outward.

In the present embodiment, the attachment portion 60 is formed of aluminum and includes the main body portion 61 attached to the bottom portion 51 of the light source holder 50 and the structure fixing portion 62 attached to the side of the main body portion 61 opposite to the light source holder 50 side.

Similar to the first embodiment, the wall lamp 1 is attached to both the ceiling sheet 3A of the plurality of wall surface sheets 3, and the airframe 2. In the present embodiment, the opening of the ceiling sheet 3A is positioned in the recess portion 54 of the light source holder 50, the fastener holes of the ceiling sheet 3A and the fastener holes 55 of the light source holder 50 are communicated with each other, and fasteners such as screws 4 are inserted and fastened into the fastener holes of the ceiling sheet 3A and the fastener holes 55 of the light source holder 50, which are communicated with each other. In this way, the light source holder 50 is attached to the ceiling sheet 3A. As described above, the four fastener holes 55 formed in the flange portion 53 function as wall surface fixing portions for fixing the light source holder 50 to the wall surface on the opposite side of the bottom portion 51 across the sidewall 52. Further, when the light source holder 50 is attached to the ceiling sheet 3A, the flange portion 53 of the light source holder 50 and the substantially lower half of the sidewall 52 are substantially in close contact with the ceiling sheet 3A, and the flange portion 53 is fixed to the ceiling sheet 3A by surface contact. Further, when the flange portion 53 is fixed to the ceiling sheet 3A, the recess portion 54 formed by the sidewall 52 and the bottom portion 51 is in a state of being positioned on the airframe 2 side with respect to the ceiling sheet 3A. Thus, the light unit 10 accommodated in the recess portion 54 is arranged on the airframe 2 side with respect to the ceiling sheet 3A.

Note that, in the example of FIG. 7, the wall lamp 1 is attached to the ceiling sheet 3A so that the ceiling sheet 3A is positioned on the cargo compartment R side with respect to the flange portion 53, but the wall lamp 1 may be attached to the ceiling sheet 3A so that the ceiling sheet 3A is positioned on the airframe 2 side with respect to the flange portion 53. Similarly, in this case, the flange portion 53 is fixed to the ceiling sheet 3A by surface contact, and the recess portion 54 is in a state of being positioned on the airframe 2 side with respect to the ceiling sheet 3A.

In the present embodiment, the cover member 14 includes the light source facing portion 14A facing the light sources 30, the sidewall 14B erected along the outer periphery of the light source facing portion 14A, and the flange portion 14C that projects radially outward from an end portion of the sidewall 14B on the side opposite to the light source facing portion 14A side. The light source facing portion 14A is formed parallel to the bottom portion 51 of the light source holder 50, such that the cover member 14 has a flat outer shape.

Here, when the length in the direction orthogonal to the bottom portion 51 of the light source holder 50 is referred to as the thickness, the maximum thickness of the cover member 14 is slightly larger than the maximum thickness of the light sources 30 as shown in FIG. 4. Therefore, when the cover member 14 is fixed to the light source holder 50, the light source facing portion 14A is arranged at a position slightly spaced from the light sources 30 on the cargo compartment R side. Further, the maximum thickness of the cover member 14 is substantially half or less of the thickness of the recess portion 54 of the light source holder 50. Therefore, when the cover member 14 is fixed to the light source holder 50, the light source facing portion 14A is arranged in the recess portion 54 of the light source holder 50.

By the way, in the case of the wall lamp of Patent Literature 1 described above, since the light source is arranged to protrude from the wall surface into the room, there is a possibility that an article in the room hits the lamp and causes damage. Further, since the light source is arranged to protrude, it is not preferable from the aesthetic appearance viewpoint.

In this regard, according to the wall lamp 1 of the present embodiment, the effects described below can be obtained.

As described above, according to the wall lamp 1, the fastener holes 55, which are wall surface fixing portions for fixing the wall lamp 1 to the wall surface, are provided on the opposite side of the bottom portion 51 across the sidewall 52. Therefore, the recess portion 54 formed by the bottom portion 51 and the sidewall 52 can be positioned on the airframe 2 side with respect to the ceiling sheet 3A, which is the wall surface, and the recess portion 54 can be directed to face the cargo compartment R side. The light sources 30 mounted on the substrate 20 are accommodated in such recess portion 54. Therefore, according to the wall lamp 1, the light sources 30 are suppressed from protruding to the cargo compartment R side, and an article or the like is suppressed from hitting the light sources 30 and causing damage to the light sources 30, the article or the like. Further, as described above, since the light sources 30 are suppressed from protruding to the cargo compartment R side, it is also excellent in aesthetic appearance.

As described above, according to the present embodiment, the wall lamp that is hardly damaged and has excellent aesthetic appearance is provided.

Further, as described above, according to the wall lamp 1, since the bottom portion 51 of the light source holder 50 is parallel to the substrate 20, substantially the entire surface of the substrate 20 facing the bottom portion 51 can be fixed to the bottom portion 51. Therefore, the heat of the light sources 30 or the substrate 20 can be effectively dissipated to the light source holder 50, and an increase in temperature of the light sources 30 or the substrate 20 can be effectively suppressed.

Further, as described above, according to the wall lamp 1, the light source holder 50 includes the flange portion 53, and the flange portion 53 comes into surface contact with the ceiling sheet 3A. Therefore, the heat dissipated to the light source holder 50 can be effectively dissipated to the ceiling sheet 3A.

Further, as described above, according to the wall lamp 1, since the fastener holes 55, which are wall surface fixing portions, are provided in the flange portion 53, the flange portion 53 and the ceiling sheet 3A can be firmly fixed by surface contact as compared with the case where the wall surface fixing portions are provided in a portion other than the flange portion 53.

Further, as described above, according to the wall lamp 1, the opening 59 for inserting the power supply wire 70 toward the substrate 20 is formed in the bottom portion 51 of the light source holder 50. Therefore, the power supply wire 70 can be connected to the substrate 20 from the airframe 2 side, which is the back side of the substrate 20, and the exposure of the power supply wire 70 is suppressed. Therefore, it is possible to further improve the aesthetic appearance when the wall lamp 1 is attached to the ceiling sheet 3A. Further, the power supply wire 70 can be connected to the substrate 20 at a short distance, and the length of the power supply wire 70 can be shortened.

Further, as described above, according to the wall lamp 1, since the opening 59 of the bottom portion 51 is closed by the substrate 20, the opening 59 can be made invisible from the cargo compartment R side, and the aesthetic appearance when the wall lamp 1 is attached to the ceiling sheet 3A can be further improved. Further, dust and the like are suppressed from entering the airframe 2 side through the opening 59.

Further, as described above, the wall lamp 1 includes the cover member 14 that covers the light sources 30. Therefore, it is possible to effectively suppress an article from hitting the light sources 30 and causing damage to the light sources 30. Further, as described above, the light source facing portion 14A of the cover member 14 facing the light sources 30 is formed parallel to the bottom portion 51. Therefore, the cover member 14 has a flat shape, and the cover member 14 does not easily protrude from the recess portion 54 even when the recess portion 54 is thinned. Therefore, even when the recess portion 54 is thinned, it is possible to effectively suppress an article or the like from hitting the cover member 14.

Further, as described above, according to the wall lamp 1, the light source facing portion 14A of the cover member 14 is accommodated in the recess portion 54. Therefore, the recess portion 54 can be thinned, and it is possible to more effectively suppress an article from hitting the cover member 14.

Further, as described above, according to the wall lamp 1, the first sheet member 11 having a heat dissipation property is arranged between the bottom portion 51 of the light source holder 50 and the substrate 20. That is, the substrate 20 is fixed to the bottom portion 51 via the first sheet member 11. By interposing the first sheet member 11 between the substrate 20 and the light source holder 50 in this way, the heat of the light sources 30 or the substrate 20 is effectively dissipated to the light source holder 50 via the first sheet member 11. Therefore, it is possible to more effectively suppress an increase in temperature of the light sources 30 or the substrate 20. Further, since the first sheet member 11 is formed of silicon as described above, the insulating property between the substrate 20 and the light source holder 50 can be increased.

Although the second aspect of the present invention has been described above by taking the second embodiment as an example, the second aspect is not limited to the present embodiment.

For example, it is not essential to provide the first sheet member 11. Since the bottom portion 51 is formed parallel to the substrate 20 as described above, the substrate 20 is fixed to the bottom portion 51 by surface contact when the first sheet member 11 is not provided. Therefore, the heat of the substrate 20 can be effectively dissipated even when the first sheet member 11 is not provided.

Further, in the second embodiment, the example in which the fastener holes 55, which are wall surface fixing portions, are provided in the flange portion 53 has been described, but the wall surface fixing portions may not be provided in the flange portion 53. However, as described above, by providing the wall surface fixing portions in the flange portion 53, the flange portion 53 and the wall surface can be more firmly fixed by surface contact, and the heat of the light source holder 50 can be more effectively dissipated to the wall surface.

Further, in the second embodiment, the example in which the light source holder 50 includes the flange portion 53 and the flange portion 53 comes into surface contact with the wall surface has been described, but such flange portion 53 may not necessarily be provided. Similarly, in this case, as described above, when substantially the entire surface of the substrate 20 facing the bottom portion 51 is fixed to the bottom portion 51 of the light source holder 50, the heat of the light sources 30 or the substrate 20 is effectively dissipated to the light source holder 50, and a favorable heat dissipation property can be achieved. However, by providing the flange portion 53 and bringing the flange portion 53 into surface contact with the wall surface, the heat dissipated to the light source holder 50 is further effectively dissipated to the wall surface, and a more favorable heat dissipation property can be achieved.

Further, it is not essential to provide the cover member 14. However, as described above, it is preferable to provide the cover member 14 from the viewpoint of protecting the light sources 30, scattering the light, and the like.

Further, in the second embodiment, the example in which the wall lamp 1 is applied to the cargo compartment of an aircraft has been described, but it is not limited to the second embodiment in the case of a structure in which the structure main body is covered by the wall surface. For example, it can be applied to the cabin of an aircraft, or it can be applied to the wall surface of a theater.

According to the wall lamp of the second aspect of the present invention, the wall lamp that is hardly damaged and has excellent aesthetic appearance is provided, and it can be used, for example, in the field of aircrafts.

The invention claimed is:

1. A wall lamp attached to both a structure main body and a wall surface covering the structure main body, the wall lamp comprising:

a light source;

a light source holder configured to be attached to the wall surface and hold the light source; and an attachment portion configured to be attached to the light source holder and the structure main body, wherein the attachment portion is formed of a material having a melting point lower than a melting point of a material forming the light source holder, and the attachment portion includes a wire accommodating portion accommodating a part of a power supply wire that supplies electric power to the light source.

2. The wall lamp according to claim 1, further comprising:

a substrate configured to be fixed to the light source holder and on which the light source is mounted, wherein the light source holder is formed with an opening communicating with the wire accommodating portion, and the opening is closed by the substrate on a side opposite to a wire accommodating portion side.

3. The wall lamp according to claim 2, wherein the substrate includes a metal layer formed separately from a wiring layer, and the metal layer covers at least a part of the opening.

4. The wall lamp according to claim 2, wherein the power supply wire accommodated in the wire accommodating portion is connected to the substrate through the opening.

5. The wall lamp according to claim 2, further comprising:

a first sheet member having a heat dissipation property configured to be sandwiched and fixed between the substrate and the light source holder.

6. The wall lamp according to claim 2, further comprising:

a retainer configured to be formed of a material having a melting point higher than a melting point of a material forming the attachment portion, wherein the substrate is sandwiched and fixed between the retainer and the light source holder.

7. The wall lamp according to claim 6, further comprising:

a second sheet member having a heat dissipation property configured to be sandwiched and fixed between the substrate and the retainer.

8. The wall lamp according to claim 1, further comprising:

a cover member having a light transmitting property configured to cover the light source.

9. The wall lamp according to claim 1, wherein the attachment portion includes a flange portion that projects toward an outer periphery of the light source holder and comes into surface contact with the light source holder.

10. The wall lamp according to claim 9, wherein the attachment portion further includes an extending portion extending from the flange portion toward the outer periphery of the light source holder.

11. A wall lamp attached to a wall surface, the wall lamp comprising:

a substrate on which a light source is mounted;

a light source holder configured to hold the substrate; and a power supply wire configured to be connected to the substrate and supply electric power to the light source, wherein the light source holder includes:

a bottom portion to which the substrate is fixed and that is parallel to the substrate, a sidewall that is erected on an outer edge of the bottom portion and forms a recess portion together with the bottom portion, and a wall surface fixing portion that fixes the light source holder to the wall surface on an opposite side of the bottom portion across the sidewall, and the light source mounted on the substrate is accommodated in the recess portion, an opening for inserting the power supply wire toward the substrate is formed in the bottom portion.

12. The wall lamp according to claim 11, wherein the light source holder further includes a flange portion that projects radially outward from an end portion of the sidewall opposite to a bottom portion side, and the flange portion comes into surface contact with the wall surface.

13. The wall lamp according to claim 12, wherein the wall surface fixing portion is provided in the flange portion.

14. The wall lamp according to claim 11, wherein the opening is closed by the substrate.

15. The wall lamp according to claim 11, further comprising:

a cover member having a light transmitting property configured to cover the light source, wherein a light source facing portion of the cover member facing the light source is formed parallel to the bottom portion.

16. The wall lamp according to claim 15, wherein the light source facing portion is accommodated in the recess portion.

17. The wall lamp according to claim 11, wherein a sheet member having a heat dissipation property is arranged between the bottom portion and the substrate.

* * * * *